US005589837A

United States Patent [19]

Soleimani et al.

[11] Patent Number: 5,589,837

[45] Date of Patent: Dec. 31, 1996

[54] APPARATUS FOR POSITIONING AN ANTENNA IN A REMOTE GROUND TERMINAL

[75] Inventors: Mohammad Soleimani, Silver Spring; John E. Corrigan, III, Chevy Chase; Mohammad Bukhari, Germantown; David A. Roos, Boyds, all of Md.

[73] Assignee: Hughes Electronics, Los Angeles, Calif.

[21] Appl. No.: 384,060

[22] Filed: Feb. 6, 1995

[51] Int. Cl.[6] ..... H01Q 3/00

[52] U.S. Cl. ..... 342/359

[58] Field of Search ..... 342/359

[56] References Cited

U.S. PATENT DOCUMENTS

| | | | |
|---|---|---|---|
| 4,862,179 | 8/1989 | Yamada | 342/359 |
| 4,881,081 | 11/1989 | Yoshihara . | |
| 5,300,935 | 4/1994 | Yu | 342/359 |
| 5,351,060 | 9/1994 | Bayne | 343/766 |

FOREIGN PATENT DOCUMENTS

| | | |
|---|---|---|
| 0261576 | 3/1988 | European Pat. Off. . |
| 0116133 | 8/1994 | European Pat. Off. . |
| 0687029 | 12/1995 | European Pat. Off. . |

*Primary Examiner*—Theodore M. Blum
*Attorney, Agent, or Firm*—John T. Whelan; Wanda K. Denson-Low

[57] ABSTRACT

An apparatus for positioning a directional antenna of a remote ground terminal which transmits and receives signals to and from a satellite via the antenna. The apparatus includes a signal generator for producing a frequency variable reference signal having a variable duty cycle, and a controller which operates to analyze the signals received from the satellite and to vary the duty cycle of the reference signal in accordance with an identification tag forming part of the received signals. The apparatus further includes a detector which receives the reference signal and produces an antenna pointing signal having an average amplitude proportional to the duty cycle of the reference signal. The controller commands the signal generator to produce a reference signal having a first duty cycle when a signal having an identification tag not corresponding to a designated central hub station is received by the antenna, and a reference signal having a second duty cycle when a signal having an identification tag corresponding to the designated central hub station is received by the antenna. The reference signal having the first duty cycle causes the average amplitude of the antenna pointing signal to equal a first value, while a reference signal having the second duty cycle causes the average amplitude of the antenna pointing signal to equal a second value. During installation, the antenna is rotated until the average amplitude of the antenna pointing signal equals the second value.

20 Claims, 3 Drawing Sheets

APPARATUS FOR POSITIONING AN ANTENNA IN A REMOTE GROUND TERMINAL

BACKGROUND OF THE INVENTION

Satellite communication systems typically have employed large aperture antennas and high power transmitters for establishing an uplink to the satellite. Recently, however, very small aperture antenna ground terminals, referred to as remote ground terminals, have been developed for data transmission at low rates. In such systems, the remote ground terminals are utilized for communicating via a satellite from a remote location to a central hub station. The central hub station communicates with multiple remote ground terminals, and has a significantly larger antenna, as well as a significantly larger power output capability than any of the remote ground terminals.

Typically, the remote ground terminals comprise a small aperture directional antenna for receiving and transmitting signals to a satellite; an outdoor unit mounted proximate the antenna which comprises a transmitter for producing and transmitting a modulated data signal and an amplifier for boosting the receive level; and an indoor unit which demodulates incoming signals and also operates as an interface between a specific user's communication equipment and the outdoor unit.

The installation of such remote ground terminals entails positioning the directional antenna in the direction of the desired satellite so as to maximize the amplitude of the signal received from the satellite. Various techniques have been utilized to aim the antenna. One known technique is to couple a signal level meter to the output of the demodulator of the indoor unit. The amplitude of the received signal is then monitored as the antenna positioned is adjusted. However, this technique has several drawbacks. First, it requires the use of additional equipment (i.e., the meter). Second, as the antenna is not located proximate the indoor unit, it requires the presence of two technicians to perform the installation.

U.S. Pat. No. 4,881,081 discloses a device for adjusting the antenna orientation which eliminates the need for two installation technicians. However, the device requires a substantial number of additional components which are dedicated exclusively for the purpose of antenna orientation.

As the viability of the remote ground terminal concept increases as the cost for providing the remote ground terminal at the remote location decreases, it is necessary to decrease the cost of the remote ground terminal as well as the costs associated with the installation thereof as much as possible.

Accordingly, to minimize the costs of purchasing and installing a remote ground terminal, there exists a need for a remote ground terminal which can be installed by a single technician and which does not require additional components dedicated exclusively for the purpose of positioning the antenna to be included in either the indoor unit or the outdoor unit. Further, there exists a need for a remote ground terminal whose installation procedure does not vary from unit to unit due to effects of temperature or operational characteristics of components.

SUMMARY OF THE INVENTION

The present invention provides a remote ground terminal designed to satisfy the aforementioned needs. Specifically, the invention comprises an apparatus for positioning an antenna of a remote ground terminal that is simple, minimizes the need for components dedicated exclusively for positioning the antenna, can be installed by a single technician and minimizes the cost associated with positioning the antenna relative to the prior art designs.

Accordingly, the present invention relates to an apparatus for positioning a directional antenna of a remote ground terminal which transmits and receives signals to and from a satellite via the antenna. The apparatus comprises a signal generator for producing a frequency variable reference signal, and a microcontroller coupled to the signal generator which operates to analyze the signals received from the satellite and to vary the duty cycle of the reference signal in accordance with an identification tag transmitted as part of the received signal. The identification tag identifies the central hub station originating the satellite signal, and the remote ground terminal is commanded to search for a specific central hub station identification tag. The apparatus further comprises a detector circuit which receives the reference signal and produces an output signal, referred to as an antenna pointing signal, having an average amplitude proportional to the duty cycle of the reference signal.

Under command of the microcontroller, the signal generator produces a reference signal having a first duty cycle when a signal having an identification tag not corresponding to the designated central hub station is received by the antenna, and a reference signal having a second duty cycle when a signal having an identification tag corresponding to the designated central hub station is received by the antenna. The reference signal having the first duty cycle causes the average amplitude of the antenna pointing signal to equal a first value, while a reference signal having a second duty cycle causes the amplitude of the antenna pointing signal to equal a second value. During installation, the antenna is rotated until the average amplitude of the antenna pointing signal equals the second value.

As described in detail below, the antenna positioning apparatus of the present invention provides important advantages. Most importantly, the novel antenna positioning apparatus utilizes components contained in the remote ground terminal which are necessary for the normal operation of the remote ground terminal. As such, the present invention minimizes the need for additional circuitry to perform the antenna positioning function, and therefore lowers the cost of the remote ground terminal relative to the prior art designs.

Another advantage of the present invention is that it eliminates the variations in the average amplitude of the antenna pointing signal due to temperature variations, or unit-to-unit variations in component performance. As a result, the installation technician no longer has to compensate for such variations.

The invention itself, together with further objects and attendant advantages, will best be understood by reference to the following detailed description, taken in conjunction with the accompanying drawings.

DETAILED DESCRIPTION OF THE DRAWINGS

Figure 1:
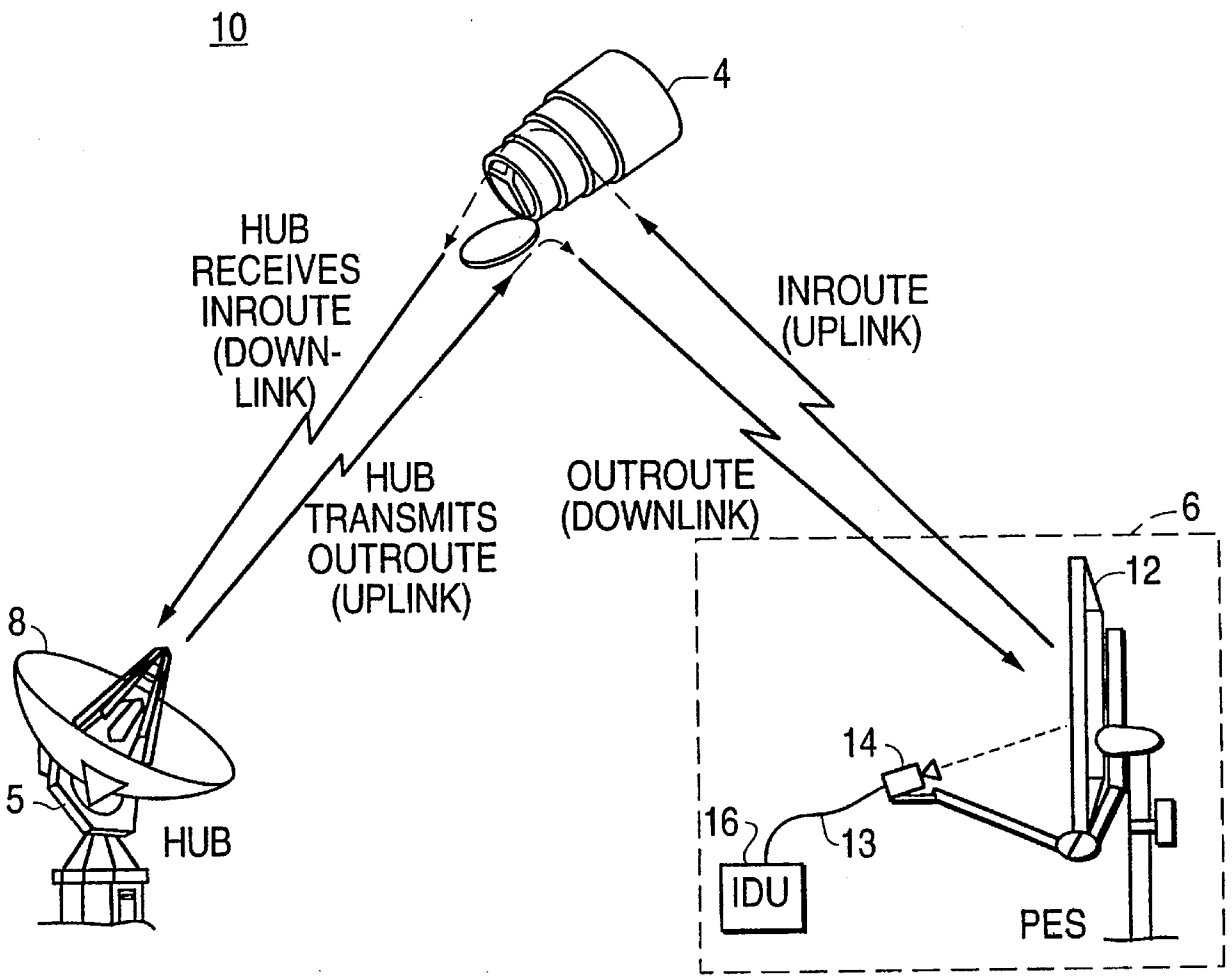
FIG. 1 is a block diagram of a very small aperture terminal ("VSAT") satellite communication network which utilizes the present invention.

The VSAT satellite communication network 10 illustrated in FIG. 1, comprises a central hub station 5, a communication satellite 4, and a plurality of remote ground terminals 6 (only one is shown). The VSAT network 10 functions as a two-way transmission system for transferring data and voice communications between the central hub station 5 and the numerous remote ground terminals 6. All data is transferred between the central hub station 5 and the remote ground terminals 6 via transponders located in the satellite 4. Signals transmitted from the central hub station 5 to the remote ground terminal 6 are referred to as "outroute", while signals transmitted in the opposite direction are referred to as "inroute".

As stated, the central hub station 5 supports a plurality of remote ground terminals 6. The central hub station 5 comprises a large antenna 8 so as to allow for the transmission of a signal sufficiently strong such that the signal can be received by the remote ground terminals 6 which have relatively small antennas. The large antenna 8 of the central hub station 5 also compensates for the relatively weak signals transmitted by the remote ground terminals 6.

As shown in FIG. 1, the communication satellite 4 functions as a microwave relay. It receives uplink signals from both the central hub station 5 and the remote ground terminals 6 at a first frequency and then retransmits the signal at a second frequency. The satellite 4 comprises a transponder which receives, amplifies and retransmits each signal within a predefined bandwidth. The transponders of the VSAT network 10 shown in FIG. 1 can operate in various frequency bands, for example, Ku and C band.

The remote ground terminal 6 comprises a small aperture antenna 12 for receiving (i.e., downlink) and transmitting (i.e., uplink) signals, an outdoor unit 14 typically mounted proximate the antenna 12 which comprises a transmitter for producing and transmitting a modulated uplink signal, and an indoor unit 16 which operates as an interface between a specific user's communication equipment and the outdoor unit 14.

In order for the remote ground terminal 6 to transmit and receive signals properly, the small aperture directional antenna 12 should be oriented at the satellite 4 so as to maximize the strength of the downlink signal received by the antenna 12. However, prior to describing the antenna positioning apparatus of the present invention, the normal operation of the indoor unit 16 and outdoor unit 14 of the remote ground terminal 6 of the present invention is briefly described.

During normal operation, the indoor unit 16 receives data from the user's equipment (not shown in FIG. 1) and modulates a reference signal in accordance with this data so as to produce the modulated data signal, which is then coupled to the outdoor unit 14. The transmitter module 20 of the outdoor unit 14 functions to amplify and frequency multiply the modulated data signal so as to produce a modulated carrier signal, which is transmitted to the satellite 4. Upon receipt by the central hub station 5, the modulated carrier signal is demodulated such that the data transmitted from the remote user is reproduced and processed by the central hub station 5.

Figure 2:
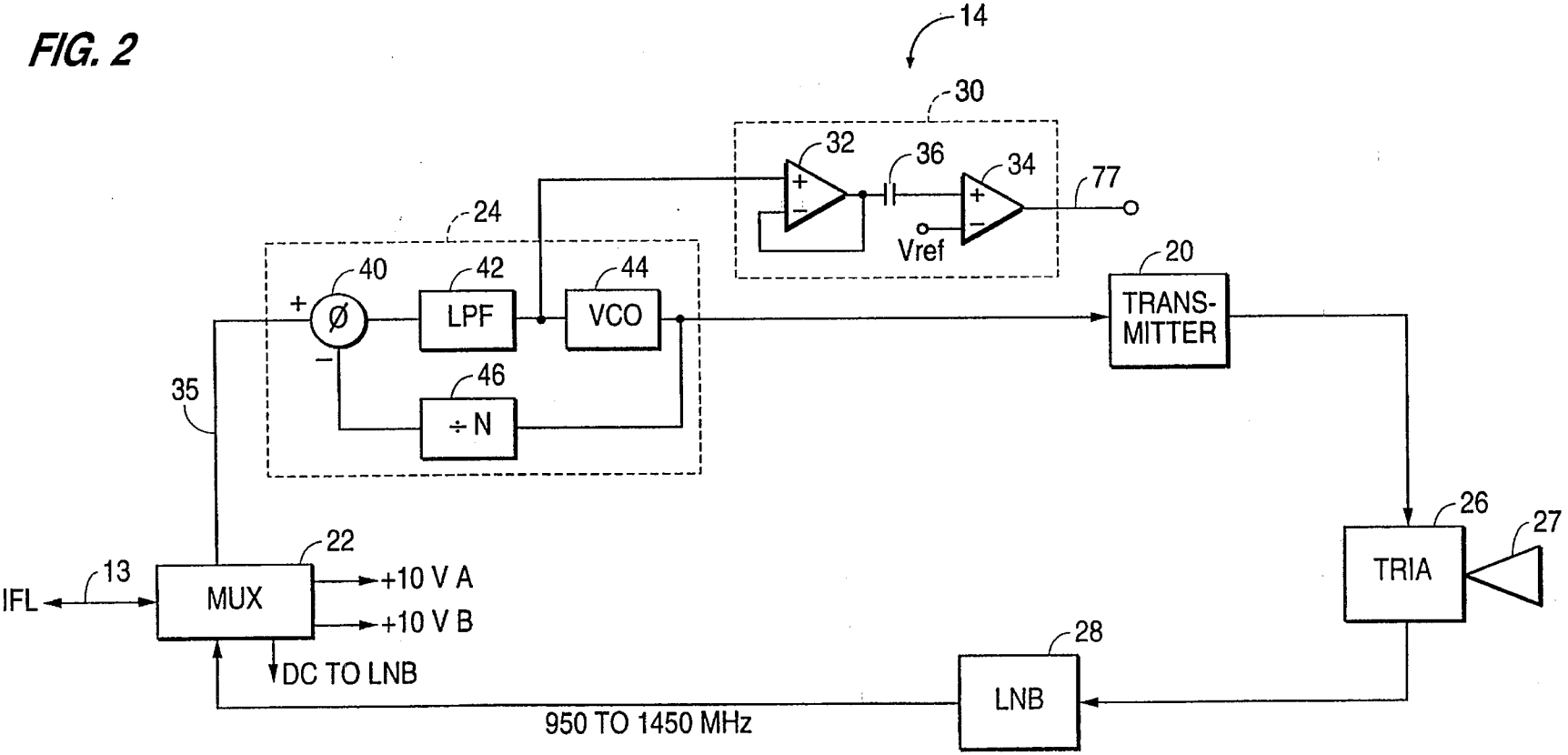
FIG. 2 is a schematic diagram of one embodiment of an outdoor unit in accordance with the present invention.

FIG. 2 is a schematic diagram of the outdoor unit 14 of the present invention. A shown in FIG. 2, the outdoor unit 14 of the present invention comprises a multiplexer 22 for receiving the modulated data signal from the indoor unit 16, a phase lock loop ("PLL") 24 for multiplying the frequency of the modulated data signal, a transmitter module 20 for amplifying and frequency multiplying the modulated data signal to generate a modulated carrier signal, and a transmit receive isolation assembly ("TRIA") 26. The output of the TRIA 26 is coupled to the antenna 12 via a feedhorn 27. The antenna 12 then transmits the modulated carrier signal to the satellite 4.

The PLL 24 of the outdoor unit 14 comprises a phase detector 40 having one input for receiving the reference signal 35, a low pass filter 42 coupled to the output of the phase detector 40, a voltage controlled oscillator ("VCO") 44 coupled to the output of the low pass filter 42, and a frequency divider 46 coupled to the output of the voltage controlled oscillator 44. The output of the frequency divider 46 is coupled to a second input of the phase detector 40 so as to complete the loop.

As shown in FIG. 2, the outdoor unit 14 further comprises a detector circuit 30 which in the present embodiment includes a buffer 32 having an input coupled to the output of the low pass filter 42 of the PLL 24 and a comparator 34 coupled to the output of the buffer 32 via a capacitor 36. As explained below, the detector circuit 30 is utilized to generate the antenna pointing signal 77.

The outdoor unit 14 also comprises a receiver chain for receiving the downlink signal from the satellite 4. The receiver chain comprises a low noise block downconverter 28 which transforms the received signal into a corresponding intermediate frequency signal. This signal is then coupled to the indoor unit 16, where it is further demodulated so as recreate the transmitted data. In one embodiment, the low noise block downconverter 28 comprises a low noise amplifier, and a mixer and local oscillator for downconverting the frequency of the received signal. Typically, the frequency of the local oscillator is fixed and the desired channel is selected from the entire downconverted band.

Figure 3:
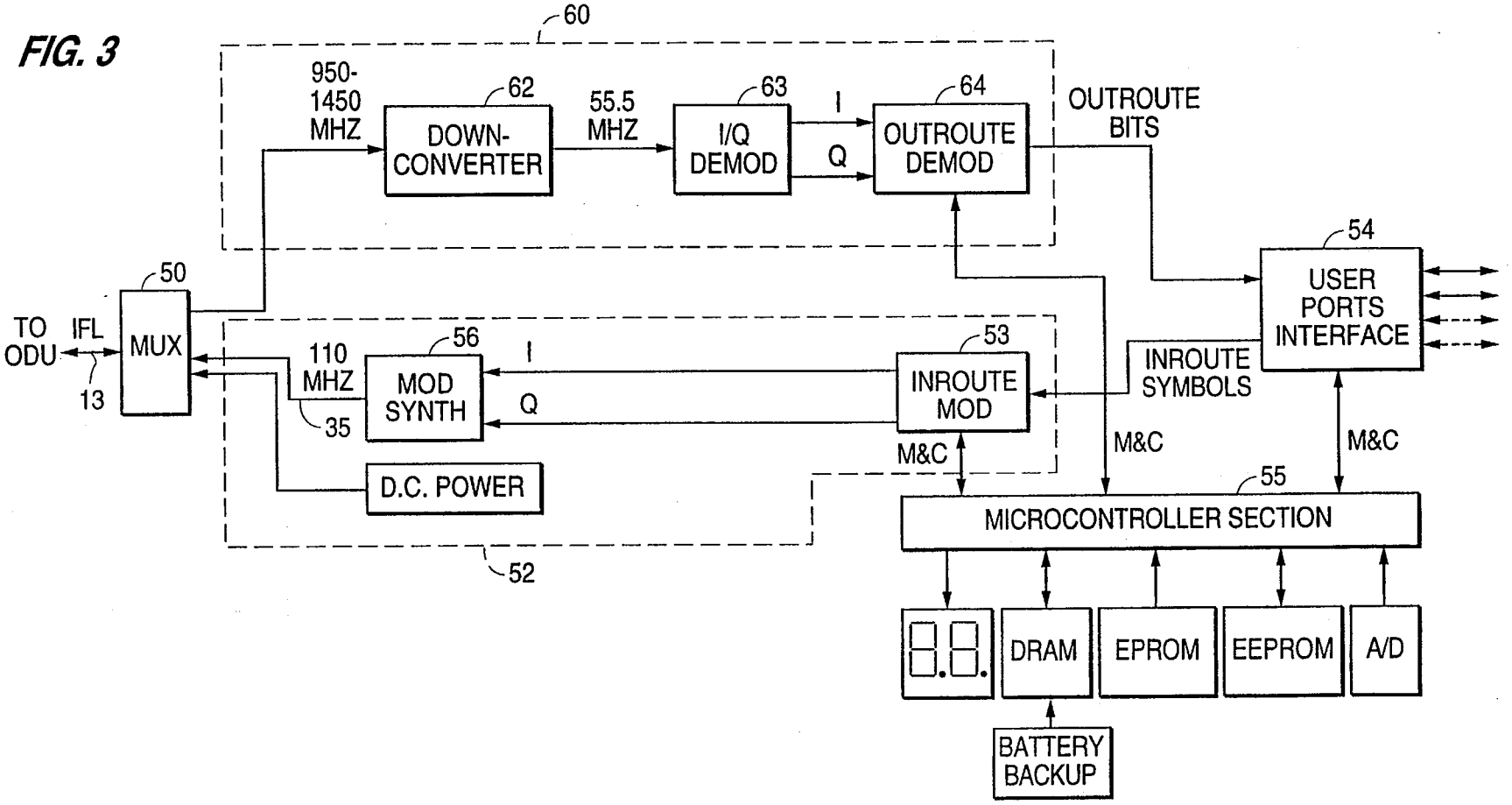
FIG. 3 is a schematic diagram of one embodiment of an indoor unit in accordance with the present invention.

FIG. 3 illustrates one embodiment of the indoor unit 16 of the VSAT network 10 of FIG. 1. As shown in FIG. 3, the indoor unit 16 comprises a multiplexer 50 having an input/output port which is coupled to the multiplexer 22 of the outdoor unit 14 via an interfacility link 13. The multiplexer 50 of the indoor unit 16 operates to combine the reference signal 35 and a DC power signal, prior to transferring these signals to the outdoor unit 14. The multiplexer 50 also operates to receive the incoming downlink signals transferred to the indoor unit 16 by the outdoor unit 14.

The indoor unit 16 further comprises a signal generation section 52 which functions to produce the frequency variable reference signal 35. As shown in FIG. 3, the signal generation unit 52 comprises a modulation synthesizer unit 56 and an inroute modulation unit 53. The modulation synthesizer unit 56 produces the frequency variable reference signal 35, and comprises in one embodiment a tunable signal generator, for example, the HSP45102 direct digital synthesizer produced by Harris Corporation, the output of which is coupled to a phase lock loop for frequency multiplying the output of the tunable signal generator. The tunable signal generator is controlled via the microcontroller 55.

During normal operation, the reference signal 35 produced by the modulation synthesizer unit 56 is modulated in accordance with I and Q modulation signals which are coupled to the modulation synthesizer circuit 56 so as to produce the modulated data signal.

The indoor unit 16 also comprises a demodulator section 60 which receives the incoming downlink signals transferred via the outdoor unit 14. As shown in FIG. 3, the demodulator section 60 comprises a downconverter 62 which further reduces the frequency of the downlink signal. The output of the downconverter 62 is coupled to an I/Q demodulator 63 which functions to divide the downlink signals into I and Q quadrature signals. The quadrature signals are then coupled to an outroute demodulator circuit 64 which analyzes the I and Q signals so as to recreate the data bits transmitted by the hub station 5. The output of the outroute demodulator circuit 64 is coupled to a microcontroller 55. The microcontroller 55 governs the flow of data within the indoor unit 16, as well as the flow of data to the user interface 54. The user interface 54 functions to couple the indoor unit 16 to the user's equipment.

Each burst or stream of data transmitted to the remote ground station 6 comprises an identification tag so as to allow the microcontroller 55 to verify that the received data was generated by the desired (i.e., designated) central hub station 5. For example, each central hub station 5 can be assigned a specific address, which is positioned as the leading bits of any data stream to be transmitted to a given remote ground terminal 6. If the address of the received signal matches the address of the designated central hub station 5, the remote ground terminal accepts and processes the data.

The operation of the antenna positioning apparatus of the present invention is now described. When attempting to orient the antenna 12 in the direction of the transmitting satellite 4, the remote ground terminal 6 is commanded into an alignment mode. In this mode, the remote ground terminal 6 receives signals in the same manner as when the remote ground terminal 6 is in the normal mode of operation. However, in the alignment mode, the outdoor unit 14 is prevented from transmitting any signals to the satellite 4. Furthermore, in the alignment mode, the satellite 4 to be focused upon must transmit a downlink signal having the proper identification tag.

As stated, in the alignment mode all received signals are processed by the receiver chain of the outdoor unit 14 and transferred to the indoor unit 16, as performed in the normal mode of operation. The demodulator section 60 of the indoor unit 16 operates to further downconvert the received signals so as to recreate the data transmitted by the satellite 4 and then transfers this data to the microcontroller 55, as performed in the normal mode. The microcontroller 55 then analyzes the received data signal.

If the received data signal contains an incorrect identification tag or no signal is received, the microcontroller 55 commands the signal generation section 52 to produce a frequency variable reference signal 35, which toggles between two predefined frequencies once during a predefined period or cycle. In addition, the reference signal 35 toggles between the two frequencies at a first specified time within the cycle such that upon demodulating the reference signal 35, as explained below, the resultant signal (i.e., the antenna pointing control signal) exhibits a first duty cycle.

Alternatively, if the received data signal is correct (i.e., contains the correct identification tag), the microcontroller 55 commands the signal generation section 52 to produce a reference signal 35 which toggles between the same two predefined frequencies at a second specified time within the same period such that the resultant signal exhibits a second duty cycle.

As stated, the reference signal 35 is coupled to the input of the phase lock loop circuit 24 of the outdoor unit 14, which functions as a detector in the alignment mode to signify whether or not the correct data signal was received.

More specifically, the amplitude of the signal output by the phase detector 40 of the phase lock loop 24 varies in accordance with the frequency of the reference signal 35. Thus, in the alignment mode, the phase detector 40 outputs a signal which varies between two different voltage levels which correspond to the first and second predefined frequencies forming the reference signal 35. As a result, the output of the phase detector 40 is substantially a digital pulse train, which hereafter is referred to as the VCO tuning voltage.

The VCO tuning voltage is coupled to one input of the comparator 34 via the buffer 32 and the capacitor 36. A reference voltage is coupled to the other input of the comparator 34, and is selected such that the output of the comparator 34 is a logic "1" when the reference signal 35 is tuned to the first predefined frequency (i.e., the VCO tuning voltage is high), and a logic "0" when the reference signal 35 is tuned to the second predefined frequency (i.e., the VCO tuning voltage is low). Accordingly, the output of the comparator 34 comprises a digital pulse train, which is referred to as the antenna pointing signal 77. The output voltage levels of the two logic states of the antenna pointing signal 77 can be made to vary from 0 volts (corresponding to a logic "0") to the voltage level of the power supply coupled to the comparator 34.

As a result, by maintaining the period of the reference signal 35 constant and varying the time at which the reference signal 35 is stepped between the first and second predefined frequencies (i.e, varying the duty cycle of the reference signal 35), the duty cycle of the antenna pointing signal 77 varies in accordance with the time at which the reference signal 35 toggles between the two frequencies. In other words, the antenna pointing signal 77 is a pulse width modulated signal, which has a pulse width equivalent to the time the first predefined frequency of the reference signal occupies a given period or cycle.

Accordingly, when the antenna pointing signal 77 is coupled to a DC voltmeter, the meter will indicate the average DC value of the antenna pointing signal 77. As such, by varying the duty cycle of the antenna pointing signal 77, which is accomplished by varying the time of transition between the first and second frequencies in a given cycle of the reference signal 35, the voltage read by the DC voltmeter can be varied in a linear manner.

The antenna pointing signal 77 is coupled to an external port of the outdoor unit 14 so that the antenna pointing signal 77 can be monitored by the installer by means of a measuring device, such as the DC voltmeter.

In accordance with the present invention, if the desired signal is not being received by the antenna 12 (i.e., the antenna is not directed at the satellite), the microcontroller 55 commands the signal generation section 52 to produce a reference signal 35 having a first duty cycle, for example 25%. Such a reference signal 35 entails generating the first predefined frequency (for example, 111 Mhz) for a quarter of the cycle, and the second predefined frequency (for example, 109 Mhz) for the remainder of the cycle. As explained above, the resultant antenna pointing signal 77 would also exhibit a 25% duty cycle. Accordingly, when measuring the antenna pointing signal 77 via the DC voltmeter, the DC voltmeter would read ¼ of the maximum voltage, for example the supply voltage. Thus, the installer by monitoring the antenna pointing signal 77 via the external port can readily ascertain that the antenna 12 is not receiving the desired signal.

Once the antenna 12 is rotated to a position so as to receive the correct signal, the microcontroller 55 commands the signal generation section 52 to produce a reference signal 35 having a second duty cycle, for example 75%. The second duty cycle causes the antenna pointing signal 77 to also exhibit a 75% duty cycle. Thus, when measuring the antenna pointing signal 77 via the DC voltmeter, the DC voltmeter would read ¾ of the maximum voltage. Accordingly, the transition of the average amplitude of the antenna pointing signal 77 from the ¼ to ¾ of the maximum voltage immediately indicates to the installer that the antenna 12 is receiving the desired signal from the appropriate satellite 4.

Of course, the duty cycle associated with receiving the correct signal can also be reversed such that the voltage level of the antenna pointing signal 77 goes down upon receiving the correct signal. Furthermore, as the microcontroller 55 can command the signal generation section 52 to vary the reference signal 35 between the first and second frequencies so as to generate virtually any duty cycle, the amplitude of the antenna pointing signal 77 can be set to substantially any value within the allowable range.

The present invention also allows the installer to fine tune the alignment of the antenna 12 with respect to the satellite 4 so as to maximize the signal strength of the received signal. Specifically, once the microcontroller 55 has determined that the desired signal has been received and commands the reference signal 35 to the second duty cycle, the microcontroller 55 measures the signal strength of the received signal. For example, the microcontroller 55 can utilize an energy per bit (Eb)/noise per hertz (NO) measurement.

The Eb/NO measurement can be performed, for example, within the outroute demodulator 64 by measuring the average magnitude of the signal and the variance about that average magnitude. Eb is proportional to the average magnitude and NO is proportional to the variance. The microcontroller 55 performs a division to calculate Eb/NO. The larger the resulting Eb/NO, the more accurately the antenna is pointing to the satellite.

The microcontroller 55 then operates to vary the duty cycle of the reference signal 35 proportionally with the strength of the received signal. As is clear from the foregoing discussion, varying the duty cycle of the reference signal 35 causes a proportional variation in the average amplitude of the antenna pointing signal 77. Thus, the installer simply adjusts the antenna 12 position until the average amplitude of the antenna pointing signal 77 reaches an absolute maximum value.

Furthermore, in addition to measuring the signal strength upon receipt of a signal having the correct identification tag, the present invention also measures the strength of the received signal prior to verifying the identification tag is correct. As a result, during the pointing process, the installer first adjusts the antenna on the basis of the raw signal level whether or not the identification tag is correct. Once the correct identification tag has been identified, the installer continues the alignment process as set forth above.

The antenna positioning apparatus of the present invention provides numerous advantages. The novel antenna positioning apparatus utilizes components contained in the remote ground terminal to provide an antenna pointing signal which indicates the strength of the received signal. Importantly, these components are necessary for the normal operation of the remote ground terminal. As such, the present invention minimizes the need for additional circuitry to perform the antenna positioning function, and therefore lowers the cost of the remote ground terminal.

Another advantage of the present invention is that it eliminates the variations in the average amplitude of the antenna pointing signal due to temperature variations, or unit-to-unit variations in component performance. As a result, installation technicians no longer have to compensate for such variations.

More specifically, any variation in the DC component of the VCO tuning voltage is eliminated by the AC coupling capacitor utilized to couple the VCO tuning voltage to the comparator. Also any variation in the slope of the VCO tuning curve will be eliminated by the comparator whose threshold is set to a value which is less than the expected variations in the VCO control voltage. Further, the voltage levels of the antenna pointing signal are repeatable from unit to unit because the comparator can be set to swing from zero volts to the value of the power supply, which is the same in each unit.

Of course, it should be understood that a wide range of changes and modifications can be made to the preferred embodiment described above. It is therefore intended that the foregoing detailed description be regarded as illustrative rather than limiting and that it be understood that it is the following claims, including all equivalents, which are intended to define the scope of the invention.

What is claimed is:

1. An apparatus for aiding the orientation of a directional antenna of a remote ground terminal which transmits and receives a signal via said antenna, said apparatus comprising:

a signal generator for producing a frequency variable reference signal having a variable duty cycle of frequency, a controller coupled to said signal generator, said controller operative to analyze said signal received via said antenna and to vary the duty cycle of said reference signal in accordance with an identification tag forming part of said signal received via said antenna, said identification tag identifying a designated central hub station which originates said signal to be transmitted to said remote ground terminal, and a detector coupled to said signal generator to receive said reference signal, said detector producing an output signal having an average amplitude proportional to the duty cycle of said reference signal, wherein said controller commands said signal generator to produce a reference signal having a first duty cycle when a signal having an identification tag not corresponding to the designated central hub station is received by said antenna, and to produce a reference signal having a second duty cycle when a signal having an identification tag corresponding to the designated central hub station is received by said antenna, said first duty cycle causing the average amplitude of said output signal of said detector to equal a first value and said second duty cycle causing the average amplitude of said output signal of said detector to equal a second value.

2. The apparatus of claim 1, wherein upon receiving said signal said controller operates to measure the signal strength of said received signal and to vary the duty cycle of said reference signal in accordance therewith.

3. The apparatus of claim 1, wherein said signal generator varies the frequency of the reference signal between a first and second frequency once during a predefined period, said duty cycle of said reference signal equaling the percentage of said predefined period that the first frequency is present.

4. The apparatus of claim 3, wherein the average amplitude of said output signal of said detector varies linearly with said duty cycle of said reference signal.

5. The apparatus of claim 1, wherein said detector comprises a phase detector which receives said reference signal as an input and which produces an output signal having an amplitude proportional to the frequency of said reference signal.

6. The apparatus of claim 5, wherein said detector further comprises a comparator having a first input coupled to the output of said phase detector and a second input coupled to a reference voltage, said reference voltage selected such that the output signal of said comparator is a logic "1" when said reference signal is tuned to said first frequency and a logic "0" when said reference frequency is tuned to said second frequency.

7. The apparatus of claim 6, wherein said detector further comprises a capacitor coupled in series between said output of said phase detector and said first input of said comparator.

8. The apparatus of claim 6, wherein said output signal of said detector is the output signal of said comparator, said output signal of said comparator coupled to an external port of said apparatus.

9. The apparatus of claim 1, wherein said controller is a microprocessor and operates to compare said identification tag forming part of said received signal to verify that the received signal originated from said designated central hub station.

10. A method for aiding the orientation of a directional antenna of a remote ground terminal which transmits and receives a signal via said antenna, said method comprising:

producing a frequency variable reference signal having a variable duty cycle, analyzing a signal received via said antenna and varying the duty cycle of said reference signal in accordance with an identification tag forming part of said signal received via said antenna, said identification tag identifying a designated central hub station which originates the signal to be transmitted to said remote ground terminal, detecting the duty cycle of said reference signal so as to produce an output signal having an average amplitude which varies proportionally with the duty cycle of said reference signal, and controlling the duty cycle of said reference signal such that when a signal having an identification tag not corresponding to the designated central hub station is received by said antenna, said average amplitude of said output signal equals a first value, and when a signal having an identification tag corresponding to the designated central hub station is received by said antenna, said average amplitude of said output signal equals a second value.

11. The method of claim 10, further comprising measuring the signal strength of said received signal and varying the duty cycle of said reference signal in accordance therewith.

12. The method of claim 10, further comprising measuring the average amplitude of said output signal so as to determine if the average amplitude equals the first or second value.

13. The method of claim 10, wherein said remote ground terminal comprises an indoor unit and an outdoor unit which are coupled to one another via a cable, said indoor unit comprising a signal generator for producing said reference signal and a controller for analyzing the signals received via said antenna, said outdoor unit comprising a detector for producing said output signal which is proportional with the frequency of said reference signal.

14. The method of claim 13, wherein said signal generator varies the frequency of the reference signal between a first and second frequency once during a predefined period, said duty cycle of said reference signal equaling the percentage of said predefined period that the first frequency is present.

15. The method of claim 14, wherein the average amplitude of said output signal of said detector varies linearly with said duty cycle of said reference signal.

16. The method of claim 13, wherein said detector comprises a phase detector which receives said reference signal as an input and which produces an output signal having an amplitude proportional to the frequency of said reference signal.

17. The method of claim 16, wherein said detector further comprises a comparator having a first input coupled to the output of said phase detector and a second input coupled to a reference voltage, said reference voltage selected such that the output signal of said comparator is a logic "1" when said reference signal is tuned to said first frequency and a logic "0" when said reference frequency is tuned to said second frequency.

18. The method of claim 17, wherein said detector further comprises a capacitor coupled in series between said output of said phase detector and said first input of said comparator.

19. The method of claim 17, wherein said output signal of said detector is the output signal of said comparator, said output signal of said comparator coupled to an external port of said apparatus.

20. The method of claim 13, wherein said controller is a microprocessor and operates to compare said identification tag forming part of said received signal to verify that the received signal originated from said designated central hub station.

* * * * *